US005082383A

United States Patent [19]

Ohishi

[11] Patent Number: 5,082,383

[45] Date of Patent: Jan. 21, 1992

[54] METHOD OF ERASING PRINTING OF THERMAL TRANSFER PRINTER

[75] Inventor: Yuki Ohishi, Tamayama, Japan

[73] Assignee: Alps Electric Co., Ltd., Tokyo, Japan

[21] Appl. No.: 499,101

[22] Filed: Mar. 26, 1990

[30] Foreign Application Priority Data

Jun. 23, 1989 [JP] Japan ..... 1-161810

[51] Int. Cl.[5] ..... B41J 29/26

[52] U.S. Cl. ..... 400/695; 400/120; 346/76 PH

[58] Field of Search ..... 400/120, 695, 696, 697, 400/697.1; 346/76 PH, 21

[56] References Cited

U.S. PATENT DOCUMENTS

| | | | |
|---|---|---|---|
| 4,320,980 | 3/1982 | Mia et al. | 400/696 |
| 4,572,687 | 2/1986 | Croley et al. | 400/696 |
| 4,724,445 | 2/1988 | Amano et al. | 400/696 |
| 4,784,502 | 11/1988 | Kobayashi | 400/697.1 |

FOREIGN PATENT DOCUMENTS

| | | | |
|---|---|---|---|
| 66241 | 6/1978 | Japan | 400/697 |
| 82077 | 5/1982 | Japan | 400/696 |
| 197249 | 1/1986 | Japan | 400/50 |
| 7583 | 1/1987 | Japan | 400/697 |

*Primary Examiner*—Edgar S. Burr
*Assistant Examiner*—Joseph R. Keating
*Attorney, Agent, or Firm*—Guy W. Shoup; David W. Heid

[57] ABSTRACT

The present invention relates to a method of erasing printing by a thermal transfer printer which is capable of erasing printing on paper. A printing area is divided into a plurality of small areas extendedly disposed in the direction in which a carriage moves. These small areas are divided into a plurality of erasure units made up of a plurality of small areas spaced apart from each other. The erasure operation is divided into two or more operations performed on each unit whereby erasure of printing is reliably performed and damage to paper is suppressed to a minimum.

3 Claims, 5 Drawing Sheets

METHOD OF ERASING PRINTING OF THERMAL TRANSFER PRINTER

BACKGROUND OF THE INVENTION

1. Field of the Invention

The present invention relates to a thermal transfer printer which prints on paper by fusing the ink of an ink ribbon to the paper by melting the ink with the heat from the heat-producing elements of a thermal head, and in particular to a method of erasing printing by a thermal transfer printer which is capable of erasing printing from paper.

2. Description of the Related Art

A conventional thermal transfer printer is known in which an ink ribbon and paper are held between a thermal head mounted on a reciprocating carriage and a platen. The functions of printing to paper or erasing printing from paper can be selected by controlling the position at which the ink ribbon is separated from the paper.

FIGS. 3, 4*a* and 4*b* show this kind of ordinary thermal transfer printer. In this printer, a platen rubber 2 for prescribing a printing position is disposed in the longitudinal direction of an extendedly disposed platen 1. An arc-shaped paper guide 4 for guiding paper 3 wound around the above-mentioned platen 1 and the platen rubber 2 so as to move around the above-mentioned platen rubber 2 is disposed under the above-mentioned platen 1. A cylindrical paper guide 4 is disposed above this paper guide 4. A thermal head 6 having a plurality of heat-producing elements 6*a* arrayed in a vertical direction at the end section of the back side in a printing direction is disposed at a position oppositely facing the above-mentioned platen rubber 2. This thermal head 6 is mounted so as to be able to separate from the platen rubber 2 on the carriage which is mounted movably in the right and left directions in FIG. 3 on a carriage holder 7 disposed along the above-mentioned platen 1. A ribbon cassette 9 in which two take-up cores 9*a*, 9*b* are provided is attached on the carriage 8. An ink ribbon 10 is housed in the ribbon cassette 9 in a state in which the ink ribbon 10 is wound around the above-mentioned take-up cores 9*a*, 9*b*. A portion of the ribbon 10 is disposed between the above-mentioned paper 3 and the thermal head 6.

A pulse motor 11 as a driving source and a gear group 12 for transmitting the rotation driving force of this pulse motor 11 are disposed on one end of the platen 1. The driving force by this pulse motor 11 is transmitted to a paper feed mechanism 5 for paper 3 and the movement mechanism for the carriage 8 via a clutch mechanism 13.

In addition, a guide mechanism 14 for the ink ribbon 10 is provided at a predetermined position at the downstream side in the direction in which the ink ribbon of the above-mentioned carriage 8 is fed. As shown in FIGS. 5*a* and 5*b*, this guide mechanism 14 comprises a solenoid 16 having a plunger 15, a lever 22 which has a rotatable connection shaft 18 connected to the above-mentioned plunger by a pin 17 and a projection 19 and which is energized in a counterclockwise direction in the figures by a lever return spring 21 in a state in which the lever is held rotatably on a rotation shaft 20, an arm driving spring 25 connected at one end with the above-mentioned projection 19 and at the other end with a projection 24 provided on an arm 23, a stopper 28 having a slit 27 which holds a hole 26 to which the above-mentioned projection 19 is loosely fitted and the above-mentioned projection 24 slidably within it, and the arm 23 which has a rotation shaft 30 rotatably holding a roller 29 which is the above-mentioned projection 24 and the ink ribbon guide and which is rotatably held on a turn shaft 31. When the above-mentioned solenoid 16 is off, the lever 22 is turned in a counterclockwise direction in the figure about the turn shaft 20 to the limit of the stroke of the plunger 15 of the solenoid 16 by the lever return spring 21. As a result, the stopper 28 rotatably held on the projection 19 provided on the end section of the above-mentioned lever 22 presses the projection 24 disposed on one end of the arm 23 at the base section of the slit 27. The arm 23 is turned in a clockwise direction in the figure about the turn shaft 31, and the above-mentioned roller 29 is held in a state in which it is separated from the paper 3.

When the solenoid 16 is turned on in this separated state, the plunger 15 of the solenoid 16 is pulled into the solenoid 16 so that the lever 22 is turned in a clockwise direction in the figure about the rotation shaft 20 against the lever return spring 21. At this time, the projection 19 to which one end of the arm driving spring 25 is connected moves as the lever 22 turns in a clockwise direction. The projection 24 to which the other end of the arm driving spring 25 is connected stops at the place because of the inertia of the arm 23, and therefore the arm driving spring 25 is extended farther than its natural length. As a result, when the arm driving spring 25 exerts a pulling force, the projection 24 is pulled and moved, which results in the arm 23 turning in a counterclockwise direction in the figure. This causes the roller 29 held on the end of the arm 23 to be pressed against paper 3.

According to the above-mentioned construction, the pulse motor 11 drives the gear group 12 and the clutch mechanism 13, thereby causing the paper feed mechanism 5 to rotate to set the paper 3 in the printing position. At this time, as shown in FIG. 4*b*, for example, the turn mechanism (not shown) of the carriage 8 is actuated to turn the thermal head 6. As a result, the thermal head 6 is held in a state in which it is separated from the platen rubber 2, i.e., in a head-up state.

When the pulse motor 11 is driven, the above-mentioned turn mechanism (not shown) of the carriage 8 is actuated. As shown in FIG. 4*a*, the thermal head 6 turns in a clockwise direction in the figure to be brought into contact with the platen rubber 2 via the ink ribbon 10 and the paper 3. The thermal head 6 is placed in a state in which transferring to the paper 3, i.e., the printing operation, or erasing printing from the paper 3, i.e., the correction operation can be performed, namely, in a head-down state.

Where printing is performed, the ink ribbon 10 is pressed against the paper 3 by the thermal head 6. At this time, the solenoid 16 of the guide mechanism 14 is turned off. As a result, the roller 29 is in a state in which it is separated from the paper 3. The above-mentioned pulse motor 11 is driven, and while the carriage 8 is moved along the platen 1, printing energy is sent to the thermal head 6, with the result that the heat-producing elements 6*a* of the thermal head 6 are selectively heat-produced to melt the ink of the ink ribbon 10 in an oppositely facing position. The ink ribbon 10 is peeled from the paper 3 while the ink is in the molten state, whereby the ink is transferred onto the paper 3, and printing is performed.

In a case where the printing transferred to the paper 3 is erased, the ink ribbon 10 is pressed by the thermal head 6 so that the ink layer side oppositely faces the printing to be erased from the paper 3. Further, the solenoid 16 of the above-mentioned guide mechanism 14 is turned on, and the roller 29 is pressed against the paper 3 in the same action as described above, with the result that the ink ribbon 10 is pressed against the paper 3 by the roller 29 also at the back side in the printing direction of the thermal head 6. That is, the ink ribbon 10 is kept in a state in which it is in contact with the paper 3 for some time after it has passed the thermal head 6. When erasure energy greater than at the printing time described above is sent to the thermal head 6 in this state and heat-producing elements 6a are selectively heat-produced, even the printed ink on the paper 3 is and the fused ink of the ink ribbon 10 and the printed ink to be erased are bonded. Then, the ink ribbon 10 which has passed the heat-producing elements 6a is kept in a state in which it is in contact with the paper 3 for some time by the above-mentioned roller 29. When the ink ribbon 10 is peeled from the paper 3 after the temperature of the ink ribbon 10 is decreased and a separation layer and the ink are solidified, the printed ink on the paper 3 becomes a single body with the ink of the ink ribbon 10, and it is separated from the paper 3 and transferred to the ink ribbon 10, completing the erasure.

Regarding the erasing of the above-mentioned printing 32 printed on the paper 3, the following two methods are available: (1) The printing 32 is stored beforehand, a printing erasure area 33a is formed so as to correspond to the printing 32 to be erased from the paper 3 at erasure time, the heat-producing elements 6a of the thermal head 6 are selectively heat-produced, and the printing is erased, as shown in FIG. 6, and (2) a printing erasure area 33b corresponding to one zone of printing is formed at erasure time without storing the printing 32, all the heat-producing elements 6a of the thermal head 6 are heat-produced, and the printing is erased, as shown in FIG. 7.

Among these methods, the method shown in FIG. 6 has a problem in that if the pitch precision of the thermal head 6 or the paper feed precision is poor, the heat-producing timing of the heat-producing elements 6a of the thermal head 6 is delayed sometimes, and therefore a portion of the printing 32 to be erased remains on the paper 3. The method shown in FIG. 7 has a problem in that since each of the heat-producing elements 6a of the thermal head 6 is heat-produced continuously, heat is stored in each of the heat-producing elements 6a and the temperature of the heat-producing elements 6a becomes above an appropriate temperature, the ink ribbon 10 is heated too much, the ink of the ink ribbon 10 is melted and fused to the paper 3, and therefore the paper 3 gets dirty.

An invention for solving the problems in the above-mentioned methods of FIGS. 6 and 7 has already been proposed by this applicant in Japanese Laid-Open Patent Publication No. 63-14507. In the invention disclosed in this Japanese Laid-Open Patent Publication, the erasure of printing in the printing erasure area 33b corresponding to one zone of printing is divided into two or more operations and performed. As the erasure is performed in such a way, no portion of the printing 32 to be erased remains on the paper 3. All the heat-producing elements 6a are not heat-produced continuously, and therefore the paper 3 is not stained due to the fusing of the ink of the ink ribbon 10.

However, in all the above-mentioned methods of FIGS. 6 and 7 and that described in the above-mentioned publication, consideration is not given to damage caused to the paper surface when printing is erased, i.e., so-called paper peeling. This paper peeling occurs owing to the reason that when the ink of the printing 32 on the paper 3 is peeled while in contact with the ink ribbon, the fibers of the paper fixed to the ink are pulled and furthermore the fibers of the paper are in a state in which many of the fibers are interwinded complicatedly. When a printing is erased, the portion of the paper 3 just under the printing 32 and the surface portion of the paper 3 in the vicinity of the down-stream end in the peeling direction of the printing 32, are peeled from the paper together with the ink, and therefore paper peeling occurs. If the range of one peeling of the printing 32 becomes wider, this paper peeling is extended farther and deepened due to a multiplied effect.

That is, according to the above-mentioned method of FIG. 6, the larger the printing 32 to be erased, the larger the damage to the paper 3. According also to the method of FIG. 7, much damage occurs to the paper 3 at any time.

On the other hand, in the method of the above-mentioned publication, to be specific, as shown in FIG. 8, the printing erasure area 33b corresponding to one zone of printing is divided in the direction in which the carriage moves and a plurality of small areas 34a extendedly disposed in a direction intersecting at right angles to the direction in which the carriage moves. These small areas 34a are erased by two operations which divide them into a plurality of erasure units made up of a plurality of small areas 34a spaced apart from each other as shown in the shaded portion of the figure, or the above-mentioned printing erasure area 33b is divided vertically and horizontally to form several tens of small areas 34b, as shown in FIG. 9, these small areas 34b being erased by dividing the erasure into two operations performed on each of the plurality of small areas 34b in a zigzag form shown in the shaded portion of the figure.

However, according to the above-mentioned method of FIG. 8, since the dimensions in the vertical direction of the small areas 34a are equal to the dimensions in the vertical direction of the printing erasure area 33b, much paper peeling occurs along one side edge in the vertical direction of each of the small areas 34a during the printing erasure time, and damage to the paper 3 is increased. On the other hand, according to the method of FIG. 9, if the small areas 34b are disposed in a zigzag form, a further paper peeling occurs during a second erasure in the vicinity of the down-stream end in the peeling direction of each of the small areas 34b in which the first erasure has been performed and paper peeling has occurred except in the vicinity of the down-stream end in the peeling direction of the printing erasure area 33b, and therefore the paper 3 is damaged greatly.

SUMMARY OF THE INVENTION

An object of the present invention is to provide a method of erasing printing of a thermal transfer printer in which the problems of the above-mentioned conventional printer are solved, printing on paper is reliably erased, and damage to the paper is reduced.

Another object of the present invention is to provide a method of erasing printing of a thermal transfer printer in which an ink ribbon and paper are held between a thermal head mounted on a reciprocating carriage and a platen and the functions of printing on paper or erasing printing from the paper can be selected by controlling the position at which the ink ribbon is separated from the paper, comprising the steps of dividing a printing erasure area on the paper into a plurality of parallel elongated areas extending parallel to the direction in which the carriage moves grouping these parallel elongated areas into a plurality of erasure groups, each group made up of a plurality of parallel elongated areas spaced apart from each other, and erasing the printing of the above-mentioned printing erasure area by erasing the printing of the parallel elongated areas of each group in a number of operations equal to the number of groups.

According to this invention constructed as described above, a plurality of parallel elongated areas extendedly disposed in the direction in which the carriage moves are formed from a printing erasure area on a paper. These small areas are divided into a plurality of groups, each group made up of a plurality of parallel elongated areas spaced apart from each other and printing is then erased from each group. Hence, paper peeling occurs only in the vicinity of small areas of the down-stream end in the peeling direction of each of the parallel elongated areas. Therefore, printing on paper can reliably be erased without much damage to the paper and without making the paper dirty.

These and other objects, features and advantages of the present invention will become clear from the following description of the preferred embodiments of the present invention, together with reference to the accompanying drawings.

DETAILED DESCRIPTION OF THE PREFERRED EMBODIMENTS

The embodiments of the present invention will be explained hereinunder, together with reference to the accompanying drawings.

FIGS. 1 and 2 show the first embodiment of the method of erasing printing of a thermal transfer printer of the present invention. In this embodiment, as shown in FIG. 1*a*, to erase the printing 32 on paper, a rectangular printing erasure is divided into parallel elongated areas 34*c*, . . . 34*c* extending in a direction in which a carriage (not shown) moves. The number of these parallel elongated areas 34*c* is set at 24, a multiple of 3, because the erasure procedure is specifically divided into three operations and performed in this embodiment.

Figure 1A:
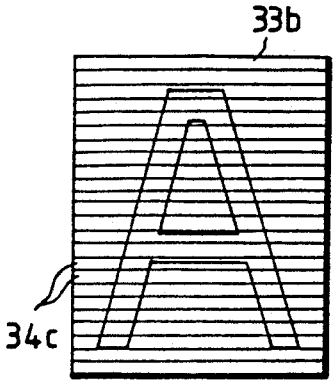
FIGS. 1(*a*), 1(*b*), 1(*c*) and 1(*d*) are explanatory views illustrating the first embodiment of the method of erasing printing of a thermal transfer printer of the present invention.
Figure 1B:
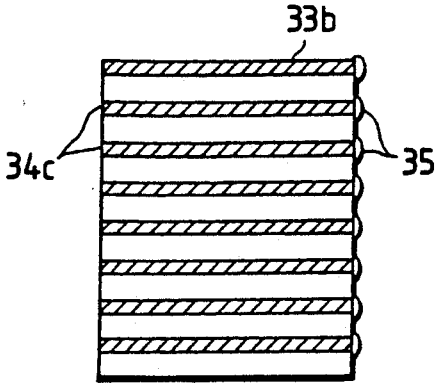

According to the above-mentioned construction, in a first erasure to be performed first, an erasure group is formed only from the parallel elongated areas 34*c* (3n-2)-th from the top when n is set at a natural number, as shown in the shaded portion of FIG. 1*b*. Only the heat-producing elements of the thermal head oppositely facing each of the (3n-2)-th parallel elongated areas 34*c* are heat-produced continuously so that erasure is performed only within each of the parallel elongated areas 34*c* constituting this erasure group and some of the ink constituting the printing 32 is transferred to the ink ribbon. At this time, paper peeling 35 occurs in the vicinity of the down-stream end which is at the right-most end in the figure, in the peeling direction of each of the (3n-2)-th parallel elongated areas 34*c*. This paper peeling 35 occurs within a small range because the width of the parallel elongated area 34*c* is small.

Figure 1C:
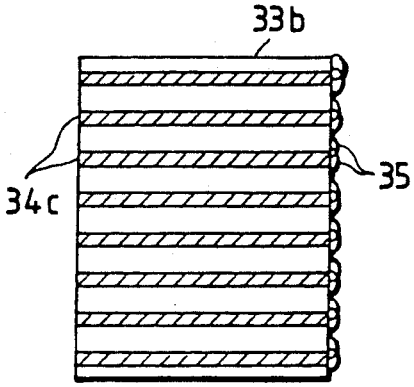
Figure 1D:
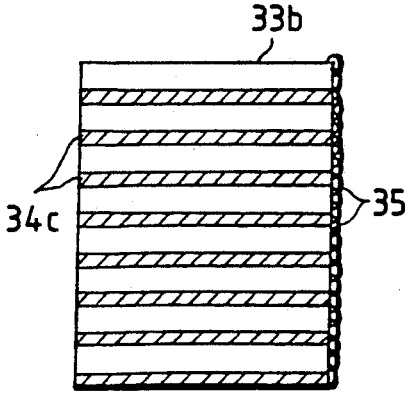

In the second erasure to be performed next, as shown in the shaded portion of FIG. 1*c*, another erasure group is formed from only the parallel elongated area 34*c* (3n-1)-th from the top. Only the heat-producing elements of the thermal head oppositely facing each of the (3n-1)-th small areas 34*c* are heat-produced continuously so that erasure is performed only within each of the small areas 34*c* constituting this erasure group, and some more of the ink constituting the printing 32 is transferred to the ink ribbon. At this time, paper peeling 35 occurs within a range in the vicinity of the down-stream end in the peeling direction of each of the (3n-1)-th parallel elongated areas 34*c*, as in the first embodiment.

In a third erasure last to be performed, still another erasure group is formed from within the small area 34*c* 3n-th from the top. Only the heat-producing elements of the thermal head oppositely facing each of the 3n-th parallel elongated areas 34*c* are heat-produced continuously and the remaining portion of the ink constituting the printing 32 is transferred to the ink ribbon, completing the erasure of the printing. At this time, the paper peeling 35 occurs within a small range in the vicinity of the down-stream end in the peeling direction of each of the 3n-th parallel elongated areas 34*c*, as in the first embodiment.

As a result of the erasure of the printing by the three operations, paper peeling 35 occurs in the vicinity of the down-stream end in the peeling direction of all the parallel elongated areas 34*c*. However, since the width of each of the parallel elongated areas 34*c* is parallel elongated, the paper peeling 35 in each of the small areas 34*c* overlap only within a small range and therefore the damage of the paper peeling 35 to the paper in this embodiment is small. There is no possibility that a portion of the printing 32 remains even if the pitch precision of the thermal head or the paper feed precision is poor since the printing 32 in the entire region of the printing erasure area 33*b* corresponding to one zone of printing is removed.

In addition, since the erasure of the printing 32 is divided into three operations and performed for each erasure group made up of a plurality of parallel elongated areas 34*c* spaced apart from each other, even if a specific heat-producing element of the thermal head is heat-produced continuously, the heat from this heat-producing element can escape in the direction of those heat-producing elements which are not producing heat. Therefore, there is no possibility of the temperature of a heat-producing element which is producing heat becoming above an appropriate temperature and there is no possibility either of the ink of the ink ribbon melting and the paper getting dirty.

As regards the above-mentioned method of dividing the printing erasure area 33*b* into a plurality of parallel elongated areas, the parallel elongated areas 33*b* may be divided in such a way that each of the neighboring parallel elongated areas are completely separated from each other. It may also be divided in such a way that neighboring parallel elongated areas overlap each other within a range of one to several dots of a heat-producing element. If neighboring parallel elongated areas are formed in this way so that some of them overlap, any unerased printing remaining at erasure time is completely eliminated and thus a more reliable erasure operation is made possible.

Figure 2A:
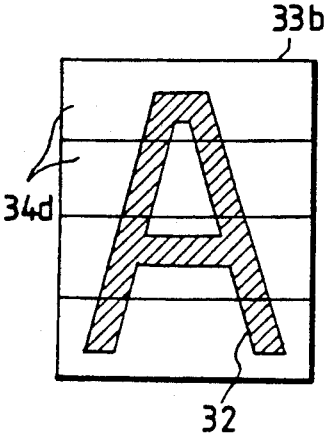
FIGS. 2(*a*), 2(*b*) and 2(*c*) are explanatory views illustrating the second embodiment of the present invention.

FIG. 2 shows the second embodiment of the method of erasing printing of a thermal transfer printer of the present invention. In this embodiment, since the erasure of the printing 32 on paper is divided into two operations and performed, the printing erasure area 33*b* shown in FIG. 2*a* is divided into parallel elongated areas 34*b*, . . . 34*b* extending in the direction in which the carriage moves.

Figure 2B:
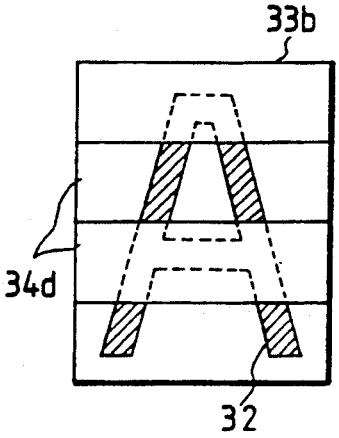

According to this construction, in the first erasure to be performed, only the heat-producing elements of the thermal head oppositely facing a first and third parallel elongated areas 34*d* are heat-produced continuously and some of the ink constituting the printing 32 is transferred to the ink ribbon so that erasure is performed only within the first and third parallel elongated areas 34*d* from the top spaced apart from each other in FIG. 2*a*. Then, as shown in FIG. 2*b*, the ink within the first and third parallel elongated areas 34*d* from the top is transferred to the ink ribbon and removed. In contrast to this, the ink of the printing 32 within the second and fourth parallel elongated areas 34*d* from the top is left as it is on the paper.

Figure 2C:
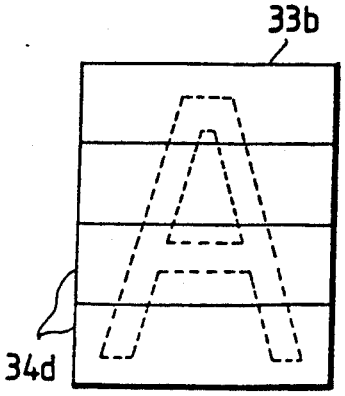
Figure 3:
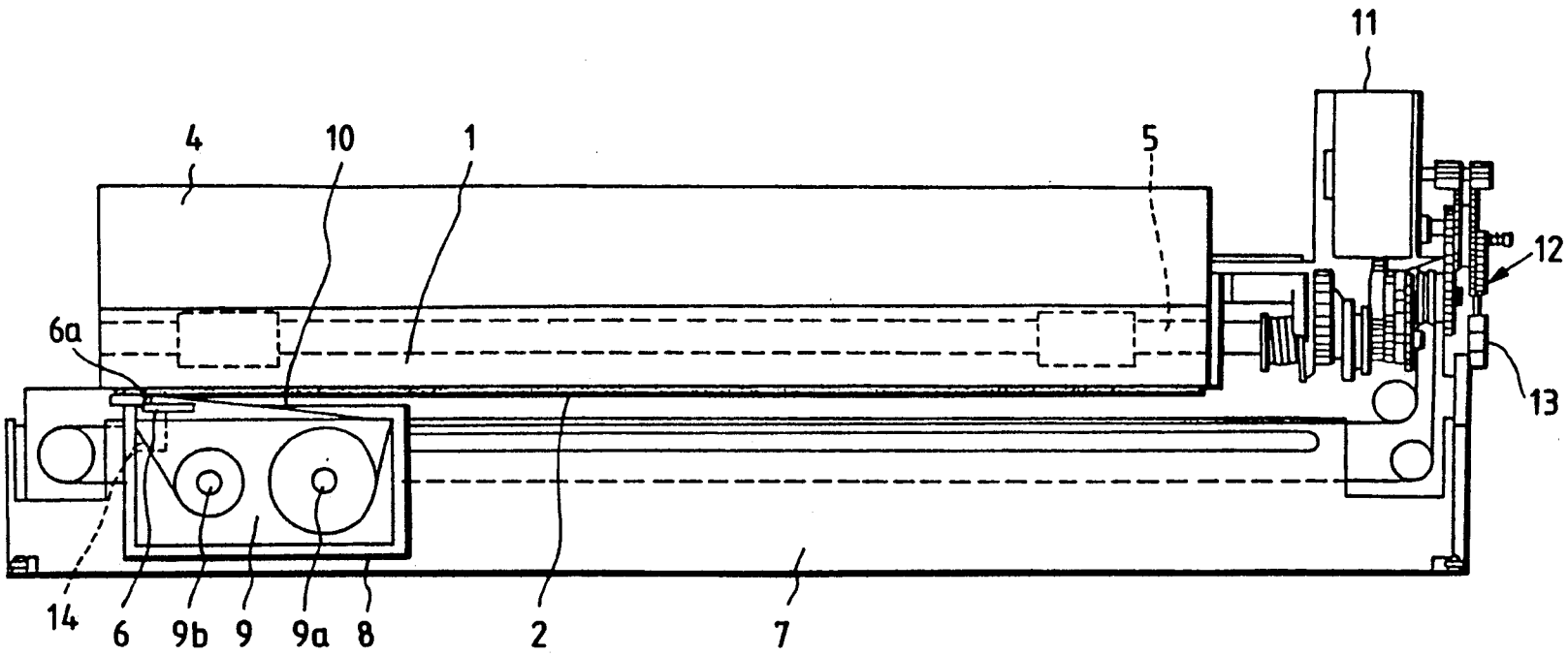
FIG. 3 is a top plan view illustrating an ordinary thermal transfer printer.
Figure 4A:
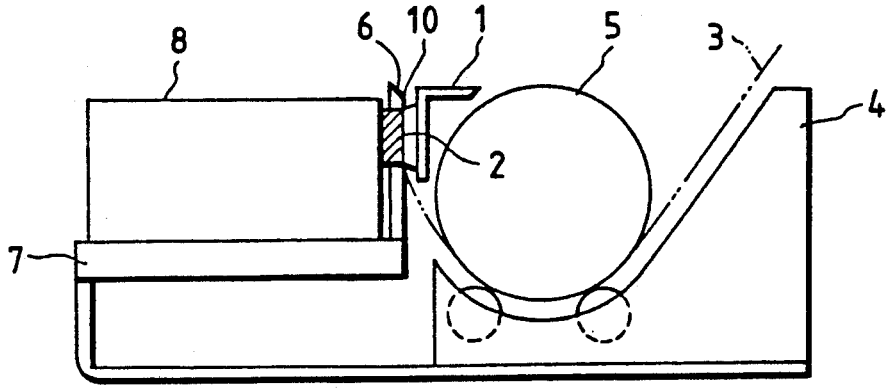
FIGS. 4(*a*) and 4(*b*) are side elevation views of the thermal transfer printer illustrating a state different from that of FIG. 3.
Figure 4B:
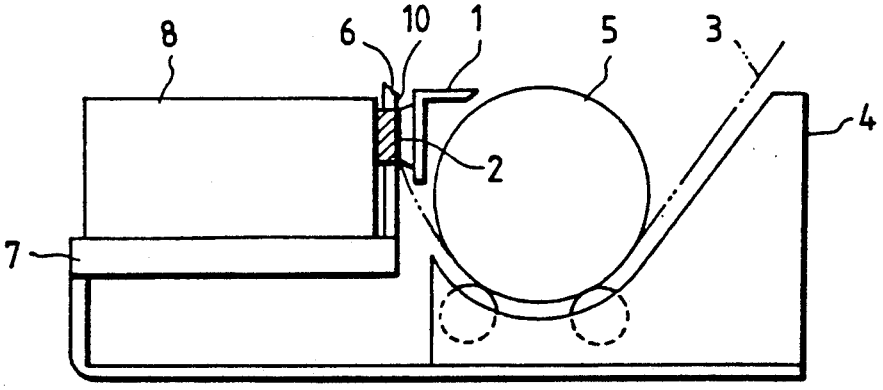
Figure 5B:
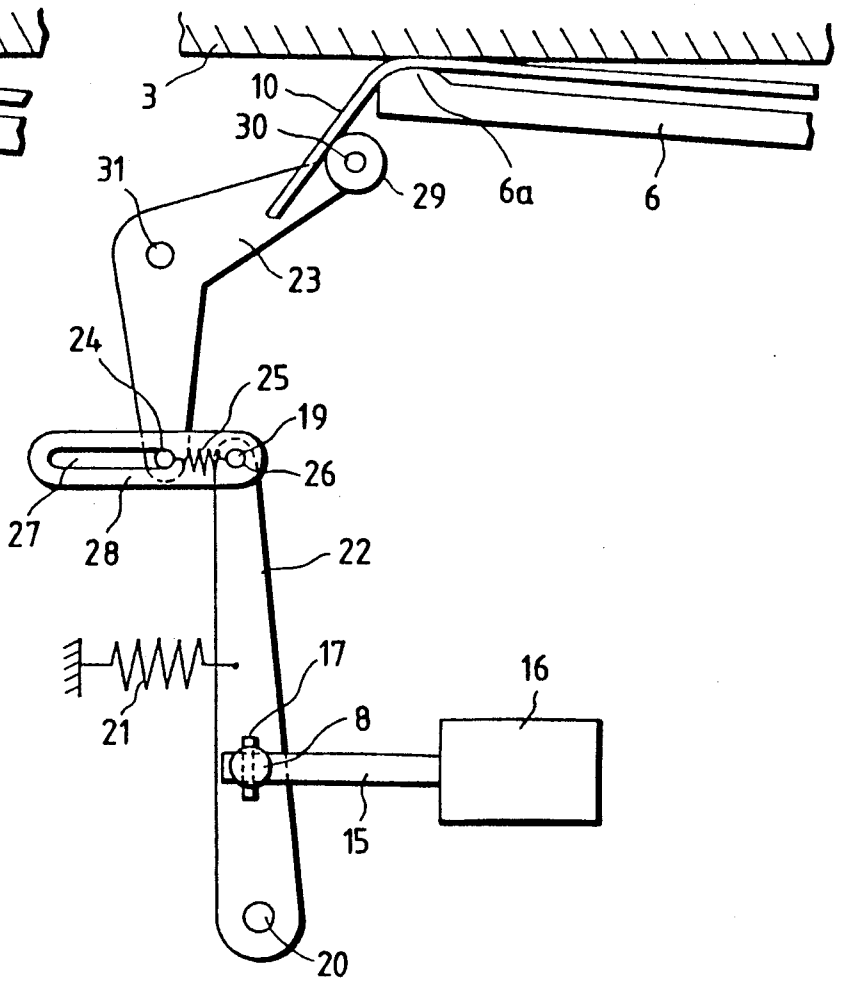
FIGS. 5(*a*) and 5(*b*) are enlarged top plan views of the thermal transfer printer illustrating a state different from an essential portion of FIG. 3.
Figure 5A:
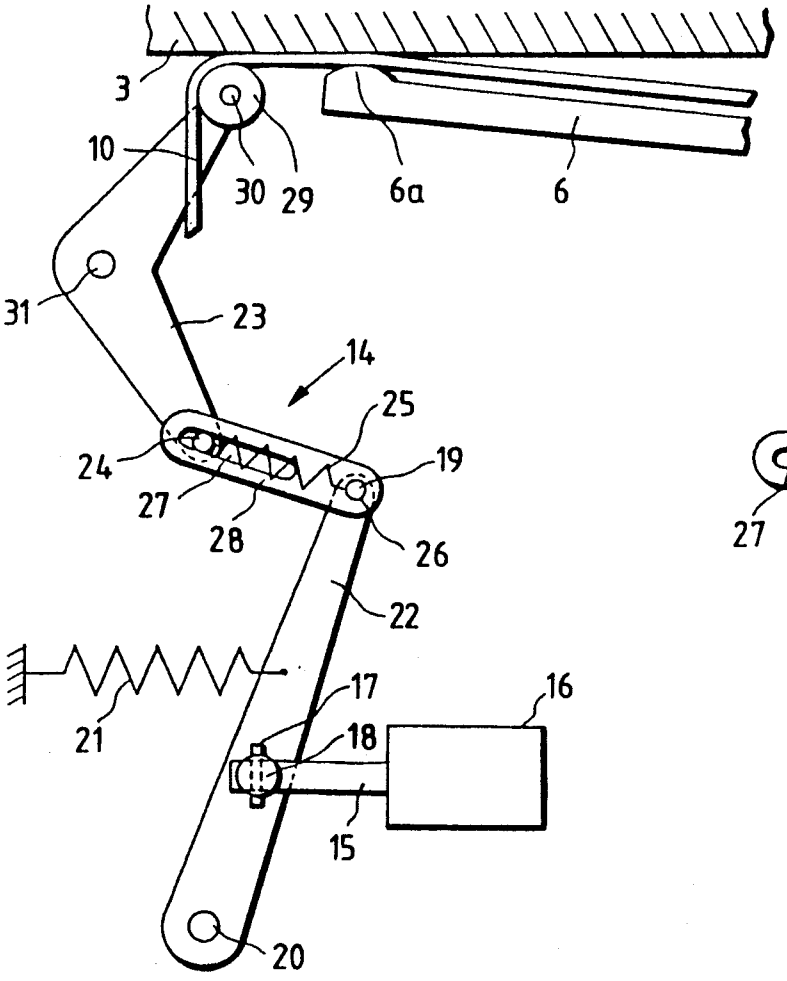
Figure 6:
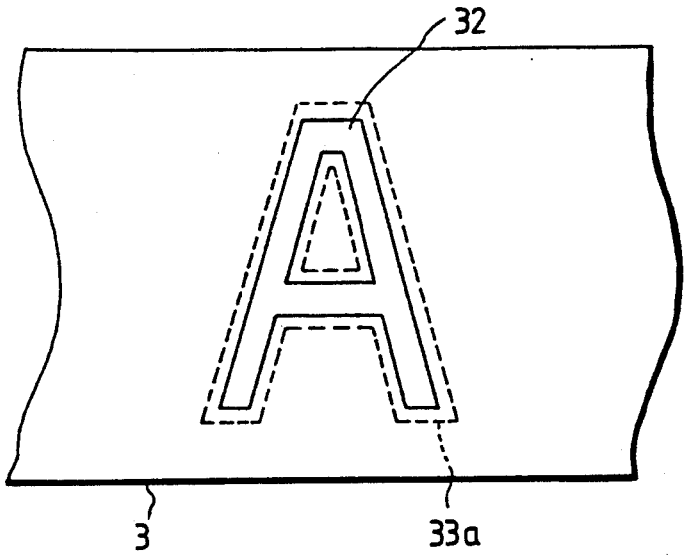
FIG. 6 PRIOR ART
FIGS. 6, 7, 8 and 9 are explanatory views illustrating the conventional method of erasing printing.
Figure 7:
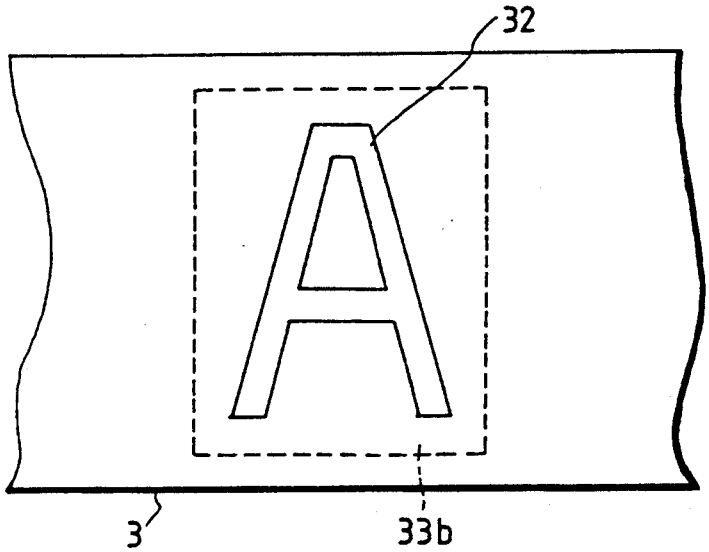
FIG. 7 PRIOR ART
Figure 8:
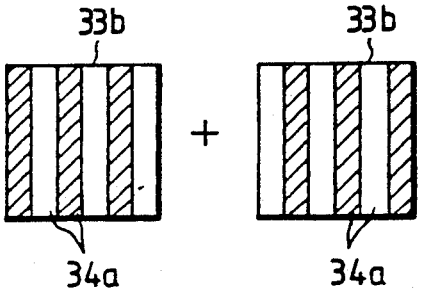
FIG. 8 PRIOR ART
Figure 9:
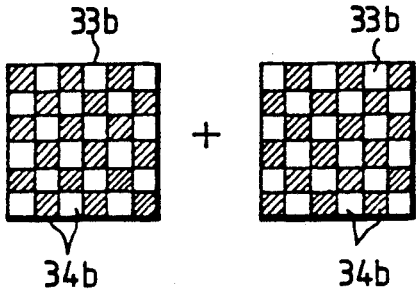
FIG. 9 PRIOR ART

In the second erasure to be performed, only the heat-producing elements of the thermal head oppositely facing the second and fourth parallel elongated areas 34*d* are heat-produced continuously and the remaining portion of the ink constituting the printing 32 is transferred to the ink ribbon so that erasure is performed only within the second and fourth parallel elongated areas 34*d* from the top, thus completing the erasure of the printing 32. Then, as shown in FIG. 2*c*, the ink of the printing 32 within the second and fourth parallel elongated areas 34*d* from the top is transferred to the ink ribbon and removed, and thus the printing 32 on the paper is all erased.

According to this embodiment, in the same way as in the above-mentioned first embodiment, although paper peeling (not shown) occurs in the vicinity of the downstream end which is the rightmost end in the figure in the peeling direction of each of the parallel elongated areas 34*d*, each paper peeling occurs within a parallel elongated range because the width of each of the small areas 34*d* is narrow and the range within which paper peelings overlap is small. Therefore, damage to paper is small. According to this embodiment also, in the same way as in the above-mentioned first embodiment, the printing 32 within the printing erasure area 33*b* can be completely erased with no remaining ink within the printing erasure area 33*b*, and there is no possibility of the paper getting dirty due to the temperature of the heat-producing thermal head.

The present invention is not limited to the above-mentioned embodiments, and various modifications may be made as required.

As set forth hereinabove, according to the present invention, the method of erasing printing of a thermal transfer printer has excellent advantages in that printing on paper can be erased reliably and without making the paper dirty, and damage to the paper can be reduced.

As many apparently widely different embodiments of the present invention can be made without departing from the spirit and scope thereof, it is to be understood that this invention is not limited to the specific embodiments thereof except as defined in the appended claims.

What is claimed is:

1. A method of removing ink from an erasure area on a print medium using a thermal transfer printer, the printer comprising a thermal head disposed to reciprocate along a path adjacent the print medium and an ink ribbon disposed between the thermal head and the print medium, said path being parallel to letter space movement of said thermal head, said thermal head also being disposed to press said ink ribbon against said print medium, said erasure area having a width parallel to the path, said method comprising:

(a) dividing the erasure area into a plurality of parallel elongated areas, each elongated area having a length equal to the width of the erasure area and being substantially parallel to the path;

(b) grouping said elongated areas into at least two groups, any two elongated areas of one of said at least two groups being separated by at least one elongated area of another of said at least two groups;

(c) pressing the ink ribbon against the erasure area by means of the thermal head;

(d) melting the ink disposed in said elongated areas of one and only one of said at least two groups such that the ink is fused to the ink ribbon;

(e) peeling the ink ribbon away from the print medium such that the fused ink disposed in said elongated areas of said one of said at least two groups is progressively removed from said print medium beginning at common first ends of said lengths and ending at common second ends of said lengths; and (f) repeating steps c) through e) for a number of times equal to the number of said at least two groups minus one so that each of said at least two groups will be erased.

2. A method of claim 1 wherein portions of adjacent ones of said elongated areas partially overlap.

3. A method of removing ink from an erasure area on a print medium using a thermal transfer printer, the printer comprising a thermal head disposed to reciprocate along a path adjacent the print medium and an ink ribbon disposed between the thermal head and the print medium; said path being parallel to letter space movement of said thermal head, said thermal head also being disposed to press said ink ribbon against said print medium, said erasure area having a width parallel to the path, said method comprising:

(a) dividing the erasure area into a plurality of parallel elongated areas, each elongated area having a length equal to the width of the erasure area and being substantially parallel to the path;

(b) grouping said elongated areas into at least two groups, any two elongated areas of one of said at least two groups being separated by at least one elongated area of another of said at least two groups;

(c) pressing the ink ribbon by means of the thermal head against the erasure area on the recording medium;

(d) causing portions of said thermal head corresponding to the ink in said elongated areas of one and only one of said at least two groups to generate heat thereby fusing said ink in said elongated areas to make the fused ink to be bonded to the ink on said ink ribbon;

(e) peeling the ink ribbon away from the print medium such that the fused ink disposed in said elongated areas of said one of said at least two groups is progressively removed from said print medium beginning at common first ends of said lengths and ending at common second ends of said lengths; and (f) repeating steps c) through e) for a number of times equal to the number of said at least two groups minus one so that each of said at least two groups will be erased.

* * * * *